United States Patent [19]

Schmid

[11] Patent Number: 4,620,407

[45] Date of Patent: Nov. 4, 1986

[54] METHOD FOR DRYWALL PATCHING

[76] Inventor: Roy Schmid, 170 Autumn Dr., Southington, Conn. 06489

[21] Appl. No.: 766,138

[22] Filed: Aug. 16, 1985

[51] Int. Cl.[4] ..... E02D 37/00

[52] U.S. Cl. ..... 52/741; 52/514; 156/98; 29/402.09

[58] Field of Search ..... 52/514, 743, 741; 30/289; 33/563, 566; 29/402.9, 402.11, 402.12; 156/94, 98; 83/455, 745, 762

[56] References Cited

U.S. PATENT DOCUMENTS

| | | | |
|---|---|---|---|
| 2,583,396 | 1/1952 | Skoog | 52/743 X |
| 3,902,940 | 9/1975 | Heller, Jr. et al. | 156/98 X |
| 4,057,898 | 11/1977 | Piosky | 33/563 X |
| 4,358,495 | 11/1982 | Parker | 52/514 X |

FOREIGN PATENT DOCUMENTS

| | | | |
|---|---|---|---|
| 2517908 | 4/1976 | Fed. Rep. of Germany | 52/514 |

*Primary Examiner*—Carl D. Friedman
*Attorney, Agent, or Firm*—Richard A. Craig

[57] ABSTRACT

Disclosed is a repair kit apparatus and a method for repairing holes in drywalls, sheet-rock or gypsum board. The repair kit comprises a template having a saw guide or diagonal slot, one or more repair plugs, patching compound and instructions for effecting the method of repairing the drywall. The template is used to cut out a portion of the drywall about the damaged area, with the drywall being at a sloped angle or contoured inwardly. The repair plug has a peripheral sloped wall edge and is dimensioned for being insertable into the cutout with its sloped wall edges abutting the sloped or contoured wall portions defining the prepared drywall cutout. The repair plug may be mounted within the drywall cutout such that its outermost (face) surface is slightly recessed below the surface of the drywall. Next, patching compound may be applied over the repair plug to form a relatively flat smooth wall surface.

2 Claims, 13 Drawing Figures

METHOD FOR DRYWALL PATCHING

FIELD OF THE INVENTION

The present invention relates to repair of walls and, more particularly, for walls made of plasterboard material. The present invention is even more particularly directed toward a method for repairing drywalls.

BACKGROUND AND PRIOR ART STATEMENT

Drywall, generally referred to as sheet-rock, provides a relatively inexpensive wall surface in numerous buildings. Drywall is, however, subject to having holes or indentations made therein during construction or later in use when struck by objects. The traditional approach to repairing such holes was first to fill the hole with a backing such as newspaper, rags, wire mesh, or the like, and then to overlay the backing with a patching compound. This method was proven undesirable because of the difficulty in maintaining the backing material in place. Even in those instances where a repair is completed, the repaired area remains a weak spot in the wall. Also, considerable time and finishing work is required.

Hitherto it has been suggested to repair damaged drywall by circumscribing the damaged part with a uniform cutout having the cut drywall surface defining the cutout hole being normal to the drywall surface, and inserting a cutout piece of wallboard of similar dimensions as the hole and holding this patch insert in place by suitable cement or by means of various spring-loaded or other devices which act on the inner surface of the opposing wall.

Such repair devices require not only an opposing wall located behind the damaged wall but also frequently require a number of mechanical parts which must be carefully secured in the proper location. U.S. Pat. Nos. 3,690,084; 2,997,416 and 3,936,988 are illustrative of such devices.

Also, it has been known to use an outside patch or laminate of sheet material having an overlay of plaster joint compound. Such repair techniques result in an outward bulge or elevated surface portion on the outside surface of the sheet-rock which is noticeable, and the repaired area remains a relatively weak spot in the wall. U.S. Pat. Nos. 4,122,222; 4,135,017 and 4,358,495 are illustrative of such devices.

Another prior art technique for repairing damage to plasterboard is illustrated in U.S. Pat. No. 4,311,656. This patent teaches the technique of sanding the plasterboard by means of a power rotating sander to a predetermined depth and then inserting a perforated plate having a plurality of securement apertures and screws.

Another prior art patent reference of general interest is U.S. Pat. No. 2,583,396. This patent is directed to patching wood veneer and plywood and does not show or suggest a method of repairing plasterboard or sheet-rock.

These patents are mentioned as being representative of the prior art and other pertinent references may exist. None of the above cited patents are deemed to affect the patentability of the present claimed invention.

The present invention involves a novel combination of features combined in such a way as to afford a solution to the long felt hitherto unresolved difficulties and problems encountered with the prior art.

For example, in contrast to the prior art, the present invention provides a repair kit having a template designed to provide a sloped or inclined circumscribed cut out in the drywall about the damaged area, enables use of different thickness plugs to repair the damaged wall, substantially eliminates surface bulging, provides a relatively strong repaired area, obviates need for plug mounting brackets, enables the user to readily form additional and different sized plugs out of virtually any thickness piece of sheet-rock or gypsum board and the like, and enables relatively quick and easy repair of a damaged area of a drywall.

SUMMARY OF THE INVENTION

The present invention, generally speaking, comprises a repair kit and method of repairing damaged drywall.

The repair kit includes a template having a saw guide slot to enable the user to circumscribe a cutout about the damaged area being defined by inwardly sloped or inclined surfaces. The repair kit may also include a mating repair plug having corresponding inwardly sloping peripheral wall edges dimensioned for being inserted into the prepared cutout and abutting about the juxtaposed sloped surfaces. Patching compound may also be provided with the repair kit.

The novel method of repairing a damaged area of drywall, i.e., sheet-rock or gypsum board or plasterboard or the like, generally comprises the steps of:

placing the template (10) over the damaged area so that the entire area is visible through the center hole or window (75) of the template;

securing the template in place;

inserting a sheet rock saw or the like into the diagonal slot of the template and piercing it through the drywall;

circumscribing a cutout in the drywall defined by an angled or sloped drywall edge(s) corresponding with the angle of the diagonal slot of the template;

rounding over the outer edges of the cutout to generally smooth any ragged saw edge forming or cutting one or more notches in the inner sheet rock wall surface(s) about the sawed cutout;

removing debris from the cutout and surrounding area of the drywall;

moistening and covering the sloped wall edges of the repair plug with a patching compound;

inserting the repair plug into the sawed cutout in the drywall to cause the patching compound to seal the juxtaposing sloped edges of the drywall cutout or notch and the repair plug, with the outer surface of the repair plug(31) being slightly (recessed) below the outer surface of the surrounding drywall;

applying patching compound (30) into this recessed area and spreading evenly over the repair plug to form a flat smooth surface with the surrounding outer surface of the drywall; and allowing the applied patching compound to dry or harden.

Accordingly, it is an object of the present invention to provide a new and improved drywall patch kit.

It is a further object of the present invention to provide a new and improved method for repairing a damaged area of a drywall such as plasterboard or sheet-rock or gypsum board and the like.

It is a further object of the present invention to provide a method and means for repairing a damaged drywall such that the repaired area is virtually as strong and resistant to an inward force or pressure as the undamaged drywall surface.

It is a further object of the present invention to enable repair of a damaged area of a drywall such that the repaired surface conforms virtually perfectly with the drywall surface.

It is a further object of the present invention to provide a repair kit having a template to provide a sloped or inclined circumscribed cutout about the damaged area.

It is a further object of the present invention to provide a method of repairing a drywall whereby several different thickness repair plugs may be used to repair kit and method to enable relatively quick and easy repair of a damaged area of a drywall.

BRIEF DESCRIPTION OF THE DRAWINGS

Other objects and advantages of the present invention will be evident from the following detailed description when read in conjunction with the accompanying drawings which illustrate the preferred embodiment of the present invention. Similar reference numerals refer to similar parts throughout.

DESCRIPTION OF THE PREFERRED EMBODIMENTS

Figure 1:
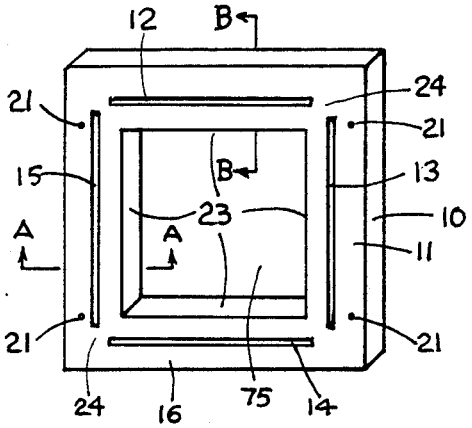
FIG. 1 is a perspective view of the template or templet in accordance with the invention.
Figure 2:
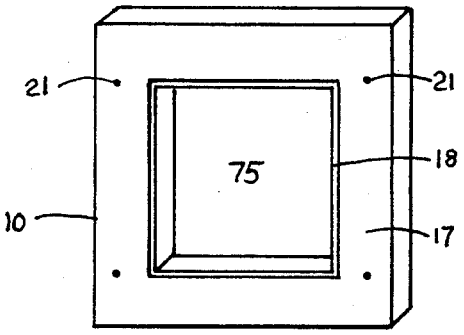
FIG. 2 is a rear view of the template shown in FIG. 1.
Figure 3:
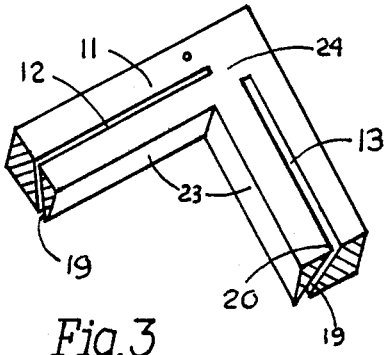
FIG. 3 is a perspective view of a cutaway portion of the template through A—A and B—B illustrating the sloped saw guide slot in accordance with the invention.

Reference will now be made to the drawings and, in particular, to FIGS. 1–3 in which there is illustrated a template 10 which constitutes a constituent member of the drywall repair kit according to the present invention. The template or templet may be formed from any suitable material such as wood, plastic or from various resin materials.

Template 10 basically comprises a square or rectangular shaped frame 11 having four saw guide slots 12,13,14 and 15 in its front surface 16. Each saw guide slot 12,13,14 and 15 is inwardly sloped and extends to the bottom surface 17 of template 10 to form a square or rectangular bottom slot or guide opening 18. For example, with particular reference to FIG. 3, saw guide slots 12 and 13 each have a corresponding predetermined slope or angle of inclination of approximately between 40 degrees and 60 degrees. Saw guide slots 14 and 15 have corresponding inwardly directed angles of inclination (not shown). A plurality of wall mounting holes 21 are provided for receiving mounting nails 22 and the like (see FIG. 11). Inner guide rail 23 is connected to template frame 11 by means of a plurality of interconnecting members or ribs 24. Each rib 24 is located at a respective corner of the square or rectangular shaped inner guide rail 23 and extends downwardly or inwardly to a depth just short of the bottom surface 17 of frame 11. In this manner a continuous, i.e., unbroken, bottom guide opening 18 is provided. Inner guide rail 23 has a sloped saw guide surface 19 spaced from and generally parallel with the sloped saw guide surface 20 of frame 11. The space between the sloped saw guide surfaces 19 and 20 define saw guide slots 12,13,14 and 15. This space is predetermined to accommodate a conventional type saw blade which is typically used to cut drywall. The saw has a blade 25 with a thickness less than the distance between saw guide surfaces 19 and 20 to enable the saw blade 25 to be inserted into guide slots 12,13,14 and 15 (see FIG. 11)

Figure 4:
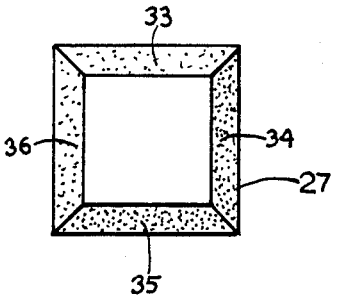
FIG. 4 is a bottom plan view of a repair plug in accordance with the invention.
Figure 5:
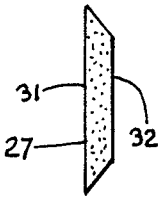
FIG. 5 is a side view of the repairs plug shown in FIG. 4.
Figure 6:
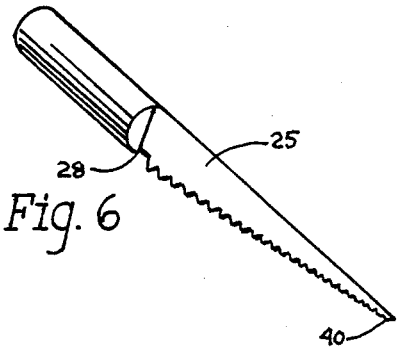
FIG. 6 is a side view of a saw device.
Figure 10:
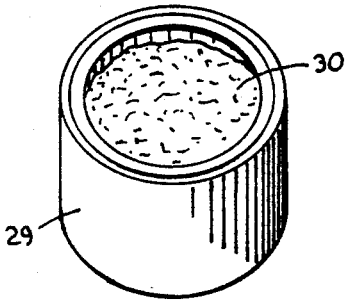
FIG. 10 is a perspective view of a container with a patching compound.

The repair kit may also include a repair plug 27 (see FIGS. 4,5), a saw 28 (see FIG. 6) and a can or canister 29 (see FIG. 10) containing patching compound 30.

The repair plug 27 has a square or rectangular shape with a front wall 31, a rear wall 32 and sloped end or edge walls 33,34,35 and 36. Repair plug 27 generally has a thickness approximately equal to the thickness of the drywall to be repaired. However, an advantageous feature of the present invention is that the repair plug 27 may be of a different thickness than the drywall being repaired. Also, the user may form other repair plugs from a (scrap) piece of, for example, sheet-rock or gypsum by using template 10 to cutout the desired plug. Repair plug 27 may be formed of any suitable material such as sheet-rock or gypsum.

Saw 28 may be of conventional design and preferably has a pointed tip 40 to facilitate insertion into the drywall.

Patching compound 30 may be of conventional design and character. The repair kit preferably includes sufficieint quantity of patching compound to do at least one or more repairs to the drywall.

Figure 7:
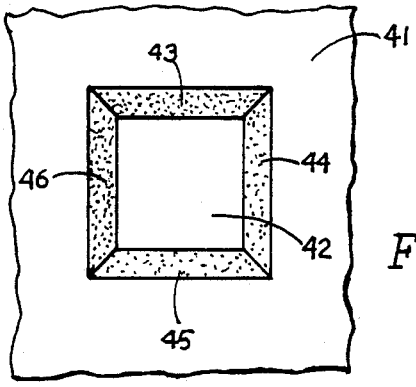
FIG. 7 is a front view of a drywall having a cut out portion in accordance with the invention.

With reference now to FIG. 7, a portion of a drywall 41 such as sheet-rock is illustrated having a square or rectangular cutout section or window 42. Window 42 is defined by the sloped wall portions 43,44,45 and 46 of drywall 41. Window 42 is formed by use of template 10 and saw 28 in accordance with the invention as more fully described below.

Generally speaking, template 10 is placed in juxtaposition with the drywall using nails or other fastening means 22 (see FIG. 11) and the saw blade 25 is inserted into a slot, such as slot 15, and through the drywall. Saw 28 is then manually manipulated, while at a sloped angle defined by slot 15, to cut a sloped section 47 in drywall 41. This procedure is repeated with saw blade 25 being inserted into slots 12, 13 and 14 to cut out a section 48 of drywall 41 containing the damaged portion 49. The cutout section is then removed which results in a window such as window 42 shown in FIG. 7 defined by sloped walls 43 through 46. Next, the surfaces of walls 43 through 46 are cleaned and moistened (not shown). Patching compound 30 is then spread about sloped walls 33 through 36 of repair plug 27, and repair plug 27 is placed over window 42 (not shown) and pressed or urged inwardly until its front wall surface 31 is slightly below the front surface of drywall 41. As can be seen from FIGS. 4–9, repair plug 27 is dimensioned to be received within the cutout section of the drywall such that sloped walls 33 through 36 align with or abut and are in mating juxtaposition with a respective sloped wall 43 through 46, with a layer of patching compound therebetween. Repair plug 27 is thereby prevented from being pressed further inwardly by the sloped walls 43 through 46 of drywall 41, thereby, serving as a backing for repair plug 27.

To provide a finished surface, additional patching compound 30 is applied over the front surface 31 of repair plug 27 to form a flat smooth surface 50 with the front surface of drywall 41. This may be effected in conventional manner such as with use of an applicator 51 and sanding (not shown) to effect the desired smoothness. It should be appreciated that this flat, i.e., not bulging, surface is possible in accordance with the invention by means of repair plug 27 being slightly undersized whereby it can be urged inwardly such that the front surface 31 of repair plug 27 is recessed very slightly below the front or other surface of the drywall 41.

Figure 8:
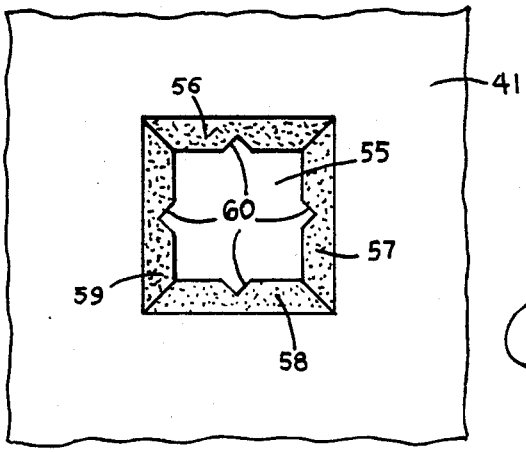
FIG. 8 is a front view of a drywall having a cut out portion containing notches in accordance with the invention.
Figure 12:
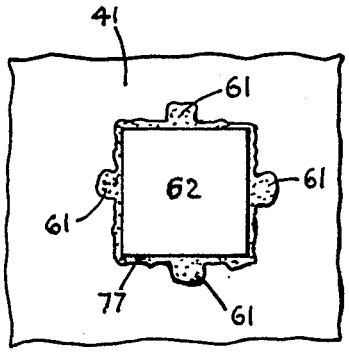
FIG. 12 is a plan rear view of the repair plug inserted into a prepared drywall window in accordance with a feature of the invention.
Figure 13:
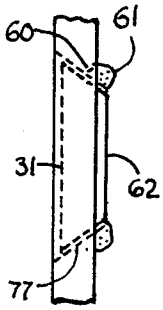
FIG. 13 is a plan side view, partly in phantom outline, of a repair plug in a drywall in accordance with the invention.

With reference now to FIGS. 8,12 and 13 an alternative embodiment or technique is illustrated for the preparation of the plug receiving window 42. Repair plug receiving window 55 and sloped walls 56–59 are similar to that shown in FIG. 7 with the exception that a plurality of notches 60 are provided in the sloped walls 56–59. Notches 60 may be provided to effect a rear wall anchor formed by patching compound 30 which, with the repair plug 62 presesed inwardly into window 55, is excreted or pressed through notches 60 to generally form a knob or rear anchor plug 61 of beaded patching compound 30. Rear anchor plugs 61 serves to provide increased holding of repair plug 62 within window 55. Another feature of the present invention is also illustrated in FIG. 13. This feature is the ability to utilize a repair plug 62 having a thickness different, for example, $\frac{3}{4}$ inch, from that of the drywall 41, for example, a $\frac{5}{8}$ inch plasterboard or sheet-rock drywall.

Figure 11:
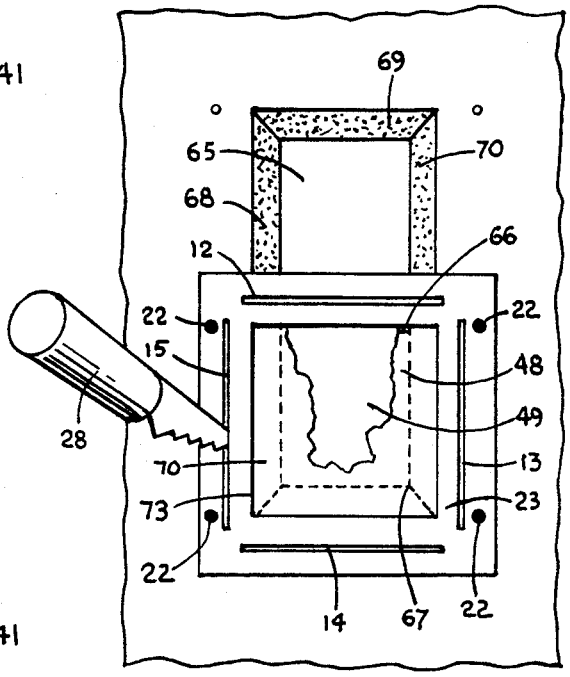
FIG. 11 is a plan view of the template being used to cutout a large section of the drywall in accordance with the invention.

With reference now to FIG. 11, another advantageous feature of the present invention is shown. At times, a homeowner or other user may be presented with a large damaged section 49 in drywall 41. To repair or replace the large damaged section 49, only a portion of which is shown, template 10 is placed over a first portion of the damaged section (not shown) and a partial window 65 may be formed with use of saw 28. Next, template 10 is relocated or disposed over the remaining portion of the damaged section 49, with the upper guide rail 23 overlapping or extending beyond the lower portion 66 of window 65. Saw 28 is then manually operated to cutout a lower window defined by phantom or dash lines 67 to form a large, e.g., rectangular, window which cut away drywall sections, such as wall section 48, contained the damaged section 49. For example, cut 73 illustrated a cut in section 48 which is accomplished by insertion of saw 28 into slot 15. Template 10 may then be used by the user to form a suitable mating repair plug (not shown) dimensioned for being received within this large cutout section or window in a manner similar to that described with reference to FIGS. 7–9. The large plug may be formed by the user, for example, from any suitable material such as a scrap piece of sheet-rock of suitable size. It being understood that, as noted above and in accordance with a feature of the invention, the repair plug(s) may be formed from a conventional sheet-rock and the like board section having the same or different thickness to the drywall 41 being repaired.

METHOD FOR USING SHEET ROCK REPAIR KIT

Step 1: Place template 10 over damaged area so that entire area is visible thru center of template, FIG. 11. Drive pins 22 into sheet rock to secure template.

Step 2: Place sheet rock saw 28 into one end of diagonal slot 12–15; thru the sheet rock and saw to end of slot. (Note) Tip of saw may require some effort and a rocking motion to force it thru the sheet rock initially. Remove saw and re-insert around corner and cut next side—repeat operation until all four sides have been cut. Remove template and the damaged sheet rock plug.

Step 3: Using a hard round (not shown) such as a pencil or pen, round over the outer edge of the opening or window 42,55 to smooth the ragged sawn edge.

Step 4: Cut four notches 60 (FIG. 8) into opening of sheet rock with saw using an outward sawing motion to prevent tearing of the backing paper or breaking the sheet rock.

Step 5: Remove all dust from edge of opening and dampen all wall edges 56–59 with water.

Step 6: Take repair plug 27 and moisten the outer edges 33–36 with water. Liberally cover all four edges with patching compound 30, then firmly press plug into opening 55 forcing the compound out between edges. Note: It is desirable to have sufficient patching compound on all four edges to insure proper sealing of edges, making sure that the entire surface of the plug is slightly below the surface of the surrounding sheet rock 41.

Figure 9:
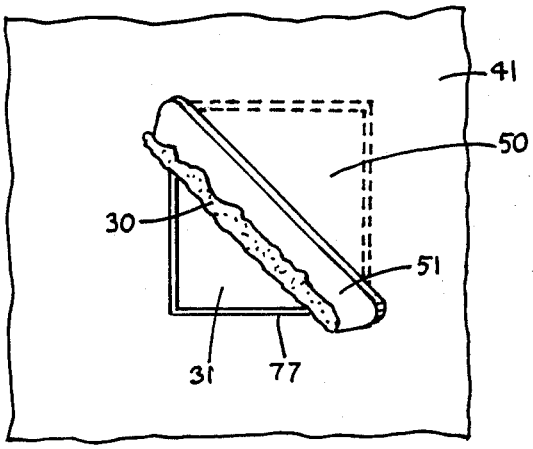
FIG. 9 is a plan view of a drywall being repaired in accordance with the invention.

Step 7: Add an additional amount of patching compound into this recessed area and using the squeegee 51, spread evenly over the plug and the surrounding area (FIG. 9). Allow to dry.

Step 8: Using fine sandpaper on a block of wood, (not shown), lightly sand the surface of the repair until it is perfectly smooth. Fill any remaining depressions with an additional covering of compound, being careful to squeegee off any excess. Allow to dry and repeat sanding step. Wall is now ready for painting.

It is to be understood that the above described arrangements are illustrative of the application of the principles of the invention. Other arrangements may be devised by those skilled in the art without departing from the spirit and scope of the invention. For example, the template could be round or of any other suitable configuration.

I claim:

1. A method of repairing a damaged portion of a previously installed drywall such as sheet-rock and plasterboard and the like, comprising the steps of:

placing a template (10) over the damaged portion of the drywall (41) so that the damaged portion is visible through a template window (75);

temporarily securing the template to the drywall;

inserting a saw blade (25) into a template slot (12,13,14 and 15) of the template and through the drywall;

circumscribing a window (42) in the drywall about the damaged portion with said window being defined by sloped wall edges (43,44,45 and 46);

removing the template from the drywall;

removing the damaged section of the drywall (48);

smoothing the outer surface of the drywall about window (41) to generally smooth any ragged edges;

removing any loose debris from and about the sloped wall edges (43,44,45 and 46);

moistening the sloped wall edges (43,44,45 and 46);

preparing a repair plug (27) with sloped wall edges (33,34,35 and 36) by moistening the sloped wall edges and covering them with a layer of patching compound;

inserting the repair plug into the window (42) put in the drywall;

applying inward pressure on the repair plug to seat the repair plug such that its sloped wall edges (33,34,35 and 36) abut or are juxtaposed with a respective one of said sloped wall edges (43,44,45 and 46) defining the circumscribed window (42), with a layer of patching compound being interposed therebetween, and with the front surface (31) of the repair plug being recessed slightly below the front surface (76) of the drywall; and applying patching compound over the front surface (31) of the repair plug to form a smooth surface (50) with the front surface (76) of the drywall.

2. A method of replacing a portion of a drywall such as sheet-rock and gypsum and the like, comprising the steps of:

placing a template (10) over the portion of the drywall to be replaced so that the portion is visible through the center window (75) of the template;

driving pins (22) through holes (21) in the template and into the drywall to secure the template thereto;

inserting a sheet-rock saw blade (25) into one end of a first diagonal slot (12) and through the drywall;

sawing the drywall to the end of said first slot (12);

removing the saw blade (12) from said first slot;

inserting the saw blade into one end of a second diagonal slot (13) and through the drywall;

sawing the drywall to the end of said second slot (12);

removing the saw blade (12) from said second slot;

inserting the saw blade into one end of a third diagonal slot (14) and through the drywall;

sawing the drywall to the end of said third slot;

removing the saw blade (12) from said third slot;

inserting the saw blade into one end of a fourth diagonal slot (15) and through the drywall;

sawing the drywall to the end of said fourth slot;

removing the saw blade from the fourth diagonal slot;

removing the template (10) and the cut portion (48) from the drywall;

rounding over the outer drywall edges defining the cut window (41,55) to smooth any ragged surface;

cutting four V-shaped notches (60) into the drywall edges (56,57,58,59) defining the cut window (55) using an outward sawing motion to substantially prevent tearing of the backing paper or breading of the drywall about the inner surface of the drywall;

removing dust and debris from the wall edges (43,44,45,46 or 55,57,58,59) of the window (42 or 55) and dampen all the wall edges with water;

preparing a replacement plug (27) by moistening its outer sloped wall edges (33,34,35,36) with water and applying a liberal layer (77) of patching compound (30) thereon;

pressing the replacement plug into the window (42 or 55) to force some of the patching compound out from between the juxtaposing sloped wall edges of defining the window and the replacement plug, so that the outer surface (31) of the replacement plug is recessed inwardly below the outer surface 976) of the drywall;

applying additional patching compound into the recessed area effected between the outer surfaces of the drywall and the replacement plug;

using a squeegee (51) to spread evenly the added patching compound over the replacement plug and the drywall outer surfaces about the window.

allowing the patching compound to dry to a hard finish; and sanding the exposed hard patching compound until the surface is substantially smooth and planar with the flat outer drywall surface (76).

* * * * *